US007394726B2

(12) United States Patent
O'Neill et al.

(10) Patent No.: US 7,394,726 B2
(45) Date of Patent: Jul. 1, 2008

(54) TIME KEEPING SYSTEM WITH AUTOMATIC DAYLIGHT SAVINGS TIME ADJUSTMENT

(75) Inventors: Terrence J. O'Neill, Lake Geneva, WI (US); Robin W. Gollnick, Lake Geneva, WI (US); Roland W. Bihler, Lake Geneva, WI (US)

(73) Assignee: Quartex, division of Primex, Inc., Lake Geneva, WI (US)

( * ) Notice: Subject to any disclaimer, the term of this patent is extended or adjusted under 35 U.S.C. 154(b) by 0 days.

(21) Appl. No.: 11/357,787

(22) Filed: Feb. 17, 2006

(65) Prior Publication Data

US 2006/0158963 A1 Jul. 20, 2006

Related U.S. Application Data

(60) Division of application No. 10/243,036, filed on Sep. 13, 2002, now abandoned, which is a continuation-in-part of application No. 10/094,100, filed on Mar. 8, 2002, now abandoned, and a continuation-in-part of application No. 09/960,638, filed on Sep. 21, 2001, now Pat. No. 6,873,573.

(51) Int. Cl.
*G04B 19/22* (2006.01)
*G04C 11/00* (2006.01)
*G04C 11/02* (2006.01)

(52) U.S. Cl. ..... 368/21; 368/46; 368/47; 368/49

(58) Field of Classification Search ..... 368/10, 368/46–55, 64, 66, 155, 156, 21, 28
See application file for complete search history.

(56) References Cited

U.S. PATENT DOCUMENTS 3,643,420 A 2/1972 Haydon
3,681,914 A 8/1972 Loewengart
3,690,059 A 9/1972 Haydon
3,756,012 A 9/1973 Kiss
3,811,265 A 5/1974 Cater
3,998,043 A 12/1976 Tamaru et al.
4,023,344 A 5/1977 Mukaiyama
4,177,454 A 12/1979 Shinoda et al.
4,182,110 A 1/1980 Kamiwaki et al.
4,395,135 A 7/1983 Frantz
4,490,050 A 12/1984 Singhi
4,525,685 A 6/1985 Hesselberth et al.
4,536,093 A 8/1985 Yoshida
4,582,434 A 4/1986 Plangger et al.
4,677,541 A 6/1987 Singhi
4,695,168 A 9/1987 Meister et al.
4,702,613 A 10/1987 Ohtawa
4,763,309 A 8/1988 Descombes
4,920,365 A 4/1990 Marx et al.

(Continued)

*Primary Examiner*—Vit W Miska
(74) *Attorney, Agent, or Firm*—Michael Best & Friedrich LLP

(57) ABSTRACT

A time keeping system having a first time module operable to keep a first time, a second time module operable to keep a second time, and a control module operatively coupled to the first time module and to the second time module. The control module adjusts the first time in response to information stored in the control module and adjusts the second time to reduce a time difference between the first time and the second time.

15 Claims, 6 Drawing Sheets

U.S. PATENT DOCUMENTS 4,953,149 A 8/1990 Marvosh
4,956,826 A 9/1990 Coyman et al.
5,089,814 A 2/1992 DeLuca et al.
5,160,853 A 11/1992 Simon et al.
5,274,545 A 12/1993 Allan et al.
5,282,180 A 1/1994 Burke et al.
5,287,109 A 2/1994 Hesse
5,293,355 A 3/1994 Widen et al.
5,297,120 A 3/1994 Yuzuki et al.
5,319,374 A 6/1994 Desai et al.
5,375,018 A 12/1994 Klausner et al.
5,387,903 A 2/1995 Cutter et al.
5,425,004 A 6/1995 Staffan
5,440,559 A 8/1995 Gaskill
5,442,599 A 8/1995 Burke et al.
5,510,797 A 4/1996 Abraham et al.
5,521,887 A 5/1996 Loomis
5,594,430 A 1/1997 Cutter et al.
5,617,375 A 4/1997 Bauman et al.
5,661,700 A 8/1997 Weppler
5,677,895 A 10/1997 Mankovitz
5,717,661 A 2/1998 Poulson
5,805,530 A 9/1998 Youngberg
5,859,595 A 1/1999 Yost
5,889,736 A 3/1999 Fujita et al.
5,982,147 A 11/1999 Anderson
6,018,229 A 1/2000 Mitchell et al.
6,061,304 A 5/2000 Nagata et al.
6,069,848 A 5/2000 McDonald et al.
6,205,090 B1 3/2001 Blount et al.
6,215,862 B1 4/2001 Lopes
6,236,623 B1 5/2001 Read et al.
6,269,055 B1 7/2001 Pikula et al.
6,288,979 B1 9/2001 Kwok
6,304,518 B1 10/2001 O'Neill
6,324,495 B1 11/2001 Steinman
6,343,050 B1 1/2002 Kwok
6,493,338 B1 12/2002 Preston et al.
6,693,851 B1 2/2004 Fujisawa et al.
6,728,533 B2 4/2004 Ishii
6,816,439 B1 11/2004 Kawahara et al.
6,873,573 B2 3/2005 Pikula et al.
2002/0018402 A1 2/2002 Egle et al.
2002/0098857 A1 7/2002 Ishii
2002/0186619 A1 12/2002 Reeves et al.

TIME KEEPING SYSTEM WITH AUTOMATIC DAYLIGHT SAVINGS TIME ADJUSTMENT

RELATED APPLICATIONS

This patent application is a divisional patent application of prior filed U.S. patent application Ser. No. 10/243,036, filed on Sep. 13, 2002, now abandoned, which is a continuation-in-part patent application of prior filed U.S. patent application Ser. No. 10/094,100, filed on Mar. 8, 2002, now abandoned, and claims priority to prior filed U.S. patent application Ser. No. 09/960,638, filed on Sep. 21, 2001, now U.S. Pat. No. 6,873,573, the entire contents of all of which are incorporated herein by reference.

BACKGROUND OF THE INVENTION

Conventional time keeping systems, such as clocks, usually require a variety of maintenance routines. The maintenance routines for power may include re-adjusting a pendulum in a gravity-powered time keeping system, rewinding a spring in a spring-driven time keeping system, or replacing batteries in a battery-powered time keeping system. Similarly, the maintenance steps for accuracy may include adjusting a display time periodically to properly display the current time, including advancing an hour during spring or retracting an hour during fall to compensate for the changes required by daylight savings time adjustment.

Many methods have been developed in an attempt to minimize, reduce, or eliminate these maintenance routines. For example, operating time keeping systems with electricity from a wall outlet or with solar cells may eliminate the power maintenance routine. Radio-controlled time keeping systems have also been developed to minimize or eliminate adjustment routines for accuracy and daylight savings time adjustment. However, these approaches add cost to the time keeping system, and restrict the areas or locations in which the time keeping system may operate. For example, a wall outlet must be available to use an electric time keeping system. Solar time keeping systems require a location with a significant source of light on a regular basis. Radio-controlled time keeping systems require locations in which radio signal reception is adequate. Therefore, a time keeping system whose operation is relatively independent of its placement whether for power or signal reception, and that still provides automatic time adjustment would be welcomed by users of time keeping systems.

SUMMARY OF THE INVENTION

Accordingly, the invention provides a time keeping system having a first time module, a second time module, and a control module. The first time module and the second time module are operable to keep a first time and a second time, respectively. The control module is operable to detect a time difference between the first time and the second time and adjust the second time to reduce the time difference.

In one embodiment, the present invention provides a time keeping system having a pulse generating module, a first time module, a second time module, a display module, an interruption module, and a control module. The pulse generating module provides a first plurality of reference pulses having a first frequency and a second plurality of reference pulses having a second frequency. The first time module is operable to keep a first time and is operable to advance the first time by a predefined amount in response to each reference pulse in the first plurality of reference pulses. The second time module is operable to keep a second time and operable to advance the second time by a predefined amount in response to each reference pulse in the second plurality of reference pulses. The display module is operable to display a display time corresponding to the second time. The interruption module is operable to prevent the second time module from advancing the second time. The control module is operable to detect a time difference between the first time kept by the first time module and the second time kept by the second time module. The control module also is operable to adjust the second frequency to reduce the time difference.

In another embodiment, the present invention provides a time keeping system having a first time module, a second time module, a display module, and a control module. The first time module and the second time modules are operable to keep a first time and a second time, respectively. The display module is operable to visually display a third time that corresponds to the second time. The control module is operatively coupled to the first and second time modules. The control module also is operable to detect a time difference between the first time and the second time. The control module is further operable to adjust the second time to reduce the time difference.

In a further embodiment, the present invention provides a system for keeping time. The system includes a first time keeping means for keeping a first time, a second time keeping means for keeping a second time, and a display means for displaying a third time. The third time may correspond to the second time kept by the second clock means. The system also includes a control means for substantially instantaneously adjusting the first time in response to information stored in the control means. The control means can further adjust the second time and the third time over a period of time until the second time substantially equals the first time.

In yet another embodiment, the present invention provides a time keeping system having a plurality of time modules. The plurality of time modules are operable to keep a plurality of independently adjustable times. The system also includes a display module that is operable to keep a display time. At least one of the plurality of time modules keeps a time corresponding to the display time. The system further includes a control module that is operable to detect a time difference. The time difference is a difference in time between the time kept by one of the plurality of time modules keeping a time corresponding to the display time and the time kept by another of the plurality of time modules. The control module also is operable to adjust a rate of advancement of one of the plurality of time modules keeping a time corresponding to the display time to reduce the time difference.

The invention also provides a method of operating a time keeping system. The method includes providing a first time, providing a second time, and providing a display time. The method also includes establishing a first series of pulses at a first pulse rate and establishing a second series of pulse at a second pulse rate. The method further includes advancing the first time by a predefined amount in response to each pulse in the first series of pulses, advancing the second time by a predefined amount in response to each pulse in the second series of pulses, and advancing the display time by a predefined amount in response to each pulse in the second series of pulses. Detecting a time difference between the first time and the second time and adjusting the second pulse rate to reduce the time difference between the first time and second time are also included in the method.

The invention further provides a method of setting a time keeping system. In one embodiment, the time keeping system includes an analog display, a first clock module, a second clock module, and a battery compartment. The battery compartment may be electrically connected to the digital display, the analog display, the first clock module, and the second clock module. The method includes setting the analog display to a position representing approximately 12 o'clock, inserting a battery into the battery compartment, setting the first clock module to a set time approximately equal to the current time, and sending signals to the second clock module and the analog display to adjust the second clock module and the analog display until they substantially equal the set time.

In another embodiment, the time keeping system includes an analog display, a first clock module, a second clock module, a control module and a battery compartment. The battery compartment may be electrically connected to the digital display, the analog display, the first clock module, and the second clock module. The method includes setting the analog display to a position representing approximately the current time and inserting a battery into the battery compartment. The method also includes adjusting a first time kept by the first clock module in response to signals from the control module and thereafter adjusting a second time kept by the second clock module and a display time kept by the analog display until the second time substantially equals the first time.

Other features and advantages of the invention will become apparent upon consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1A:
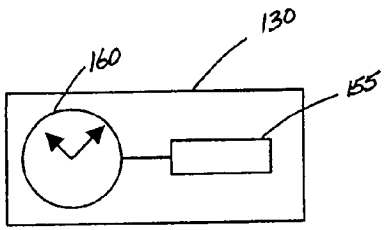
FIG. 1A is a schematic diagram of an analog clock movement unit for use with a time keeping system in accordance with the present invention.
Figure 1B:
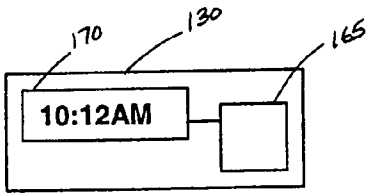
FIG. 1B is a schematic diagram of a digital clock movement unit for use with a time keeping system in accordance with the present invention.
Figure 1:
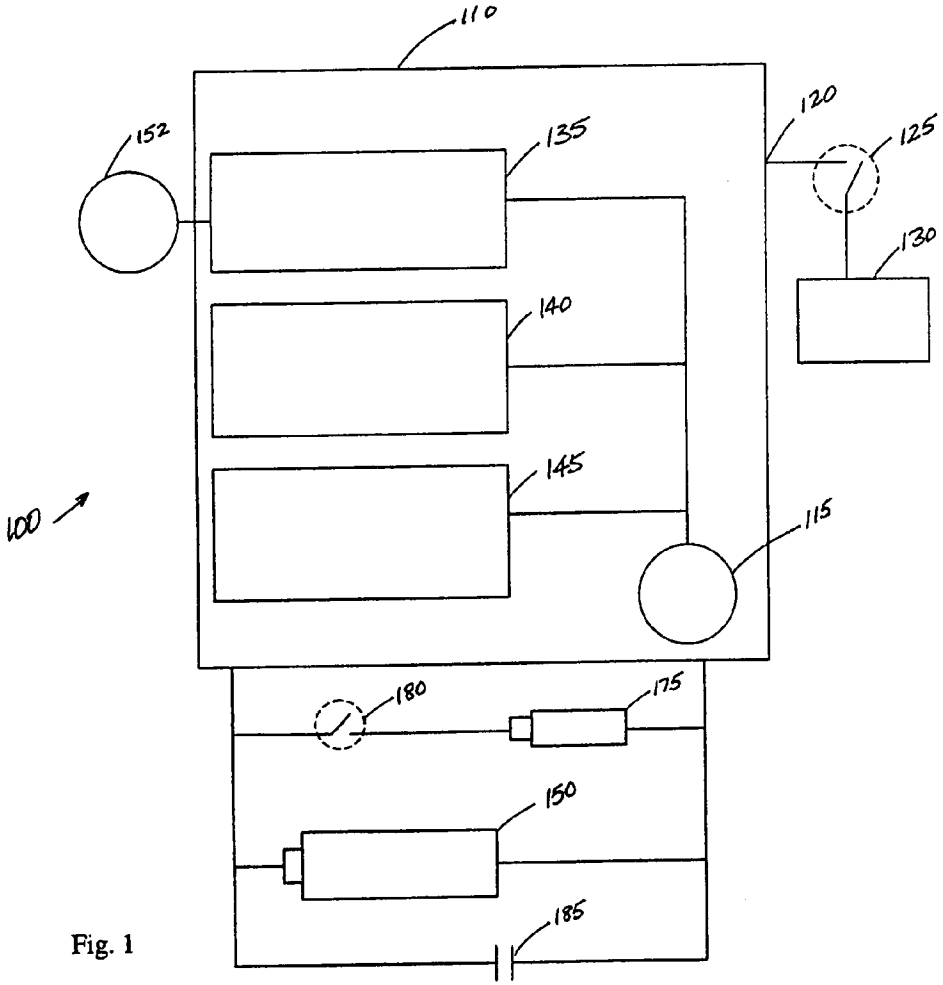
FIG. 1 is a schematic diagram of a first embodiment of a time keeping system in accordance with the present invention.

FIG. 1 illustrates the functionality of a first embodiment of a daylight savings time clock system 100 in accordance with the present invention. The daylight savings time clock system 100 includes a processor 110, which receives programming information through a programming pad 115 and sends a series of timed-pulses from a driver output 120 through a standby switch 125 to a clock movement unit 130. The processor 110 further includes a preprogrammed internal clock module 135, a preprogrammed daylight savings time setting module 140, and a low power detection module 145. The preprogrammed internal clock module 135 and the preprogrammed daylight savings time setting module 140 are programmed with time information and daylight savings changes through the programming pad 115 during the manufacturing process. These changes preferably include dates and times for daylight savings changes and a calendar that includes a number of days in leap years, non-leap years, and millennium leap years. The low power detection module 145 detects a low operating power level in the system 100, as will be more fully discussed below.

Under normal operating circumstances, the time keeping system 100 is powered by a primary battery 150, and the internal clock module 135 is controlled by a frequency generating unit (e.g., a quartz crystal) 152. However, if the primary battery 150 is removed, a reserve power source or a backup battery 175 is coupled to the processor by closing a backup switch 180. According to the present invention, the backup switch 180 could be closed or activated in a number of different manners. The switch 180 could be manually closed by a user, or the switch 180 could be mechanically closed upon the removal of the primary battery 150. In another embodiment, the switch 180 is electronically controlled by the processor 110. To ensure that the power provided to the processor 110 is not interrupted during the battery removal or replacement process, a capacitor 185 is operatively coupled in parallel to the primary battery 150.

Figure 1C:
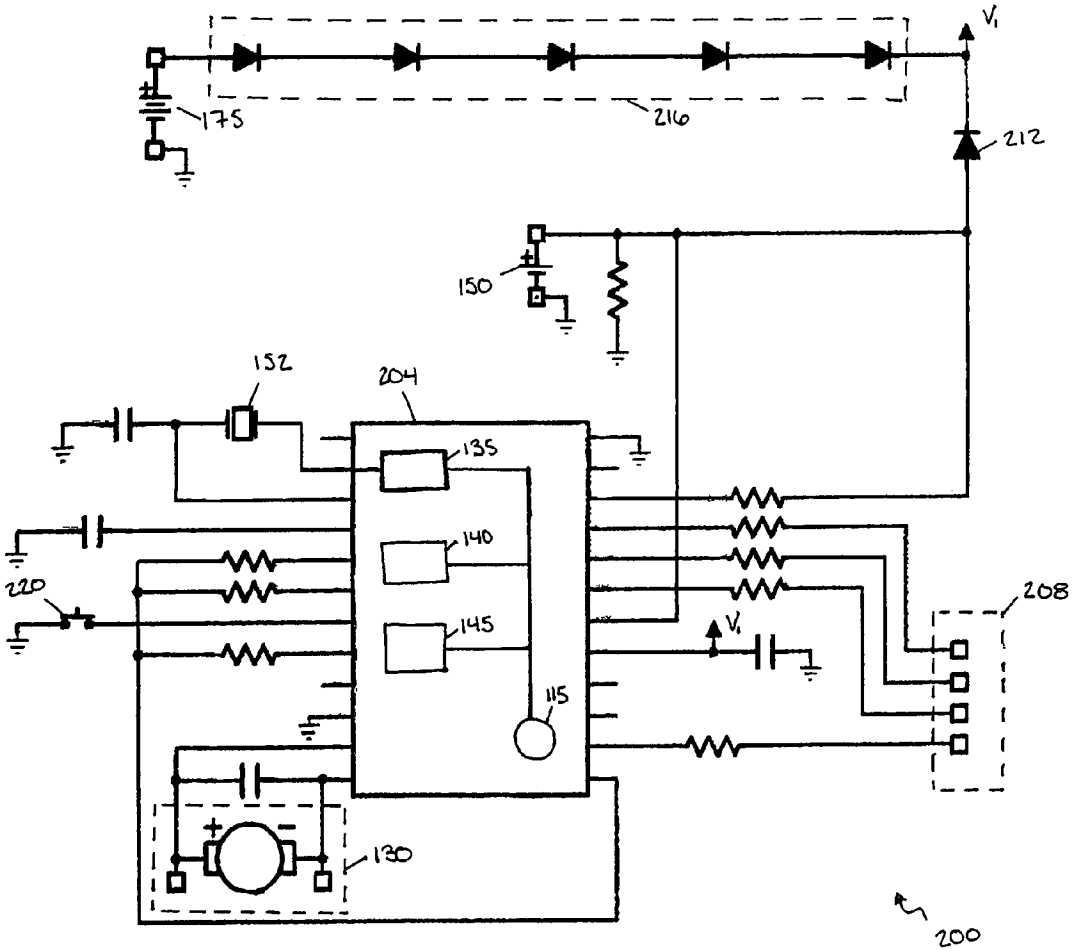
FIG. 1C is a schematic diagram of a second embodiment of a time keeping system in accordance with the present invention.

In a second embodiment of the present invention illustrated in FIG. 1C, a daylight savings time keeping system 200 includes a processor 204. The processor 204 includes the same modules and features included in the processor 110. However, the processor 204 also monitors the voltage of the primary battery 150 and, then, automatically performs the functions of the switches 180 and 125 in the event of low power detection or insertion of a new primary battery. When the processor 204 detects a low voltage output from the primary battery 150, the processor 204 disconnects the primary battery 150 and switches to the reserve power source or backup battery 175. Once the system 200 is being powered by the backup battery 175, the processor 204 deactivates the clock movement unit 130 to preserve the backup battery 175. The processor 204 does not re-activate the clock movement unit 130 until a new primary battery 150 is inserted and the processor does not detect a low voltage output from the new primary battery 150.

In the embodiment shown in FIG. 1C, the daylight savings time keeping system 200 further includes a programming interface 208, which allows the internal clock module 135 of the processor 200 to be programmed with time information and daylight savings changes before or after the manufacturing process. The programming interface 208 allows the quartz crystal 152 to be measured for any degree of error between the desired frequency required by the processor 200 and the actual quartz crystal frequency. The internal clock module 135 is then programmed to make adjustments which compensate for the error.

The system 200 also includes a protection diode 212, which prevents the current generated by the primary battery 150 to reverse its flow. A diode series 216 coupled to the backup battery 175 decreases the voltage level generated by the backup battery 175 to an acceptable level required by the processor 204. The system 200 also includes a time setting interface 220. The interface 220 allows the user to set the time that is desired to be displayed. For an analog display 160 (FIG. 1A), the user manipulates the position of the hands through the time setting interface 220. For a digital display 170 (FIG. 1B), the user identifies the time illuminated on the display component 170 using the time setting interface 220.

Referring to FIGS. 1, 1A, 1B, and 1C the processor 110 (FIG. 1) or 204 (FIG. 1C) sends out a series of timed-pulses at a first number of pulses per cycle (one pulse per second, for example) to drive the clock movement unit 130. In one embodiment, the clock movement unit 130 includes a stepping motor 155 and an analog display 160 (FIG. 1A). In another embodiment, the clock movement unit 130 may include a digital display component 165 and a digital display 170 (FIG. 11B).

Figure 2:
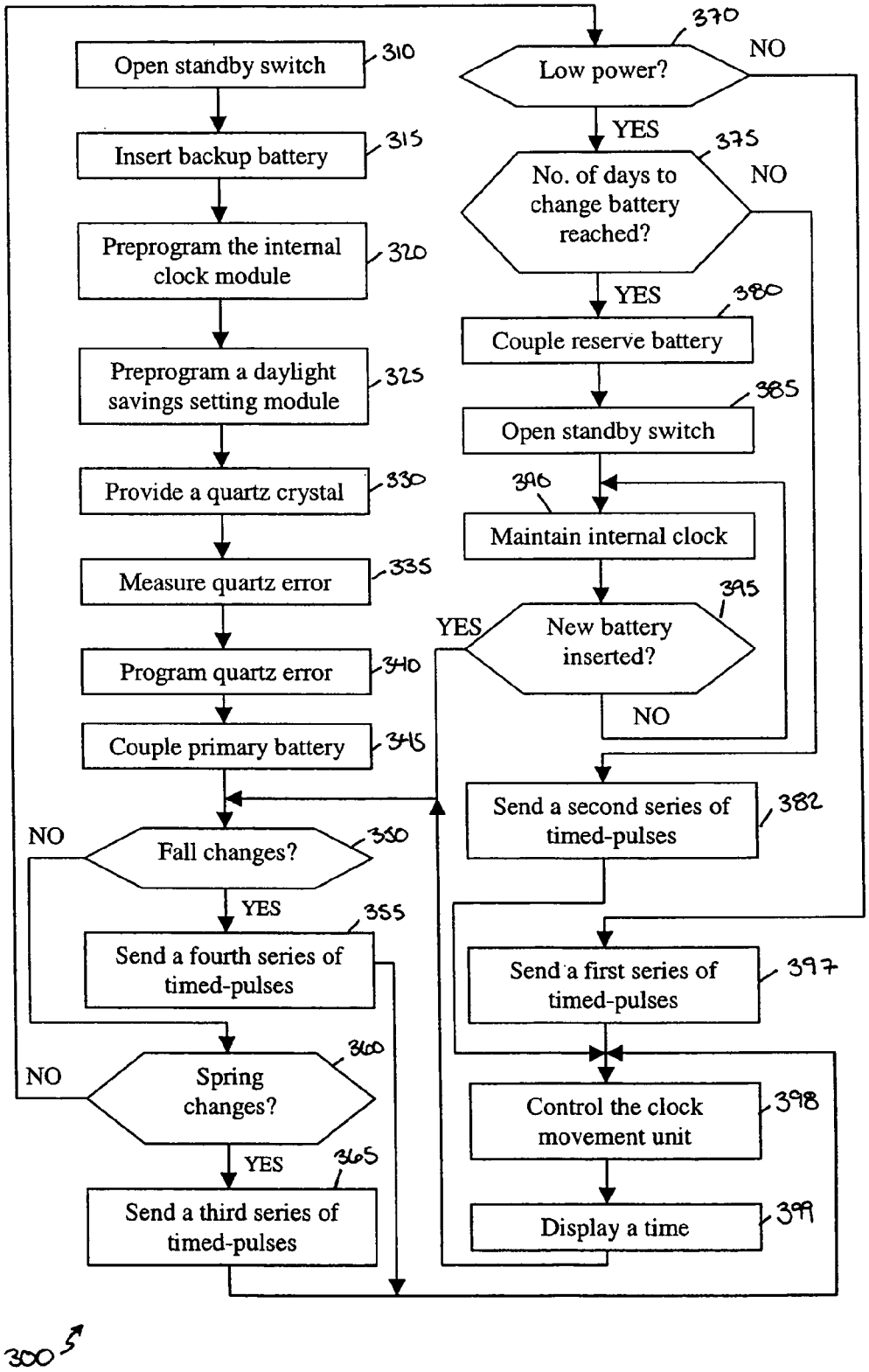
FIG. 2 is a flow diagram illustrating the functionality and operation of one embodiment of a time keeping system in accordance with the present invention.

Referring now to FIG. 2, a flow diagram 300 illustrates the functionality and the operation of a daylight savings time keeping system 100 or 200 according to the present invention. The flow diagram 300 starts with a manufacturing process in which the standby switch 125 (refer back to FIG. 1 for the reference numerals relating to the structure referred to in the various steps of the process shown in FIG. 2) is opened in step 310, and a backup battery 175 is inserted in step 315. During the same manufacturing process, the internal clock module 135 is programmed with a time, a date, and a year in step 320. The daylight savings setting module 140 is also programmed with a plurality of daylight savings changes in step 325 or it may be preprogrammed during the chip manufacturing. A quartz crystal 152 is provided in step 330. The quartz error is then measured in step 335 and programmed into the processor 110 or 204 in step 340 to compensate for the difference between the desired frequency required by the processor and the actual quartz crystal frequency.

A user then sets the time keeping system 100 or 200 to a correct time with a set button (not shown) and inserts a primary battery 150 in step 345. Inserting the primary battery 150 opens the backup battery switch 180 and closes the standby switch 125 to allow a reception of pulses from the processor 110 or 204, as discussed above.

The processor 110 or 204 checks the time and the date on a regular basis against the programmed daylight savings changes in the daylight savings setting module 140. If both the date and the time agree with the preprogrammed daylight savings changes, the processor 110 or 204 will send a particular series of timed-pulses. For example, if the time calls for the retracting of time (e.g., in the fall as determined in step 350), the processor 110 or 204 sends a fourth series of timed-pulses, or one pulse per five seconds in step 355 to slow down the display time until the one hour adjustment is complete. Otherwise, if the time calls for the adding of time (e.g., in the spring, as determined in step 360), the processor 110 or 204 sends a third series of timed-pulses, or eight pulses per normal second in step 365 to speed up the display time until the one hour adjustment is complete.

If no daylight savings change is required (NO output path of step 360), the processor 110 or 204 proceeds to check for low operating power level in step 370. If the operating power level is not low, the processor 110 or 204 sends a first series of the timed-pulses. Otherwise, when the operating power level is low, and a new primary battery is not inserted to replace the drained battery 150 within a number of days (determined in step 375), the backup battery switch 180 is closed in step 380 to allow the backup battery 175 to provide power to the processor 110. Alternatively, the processor 204 automatically switches to the backup battery 175 when low voltage from the primary battery 150 is detected. A second series of timed-pulses will then be sent by the processor 110 or 204 to the clock movement unit 130. The second series of timed-pulses might preferably include two pulses every other second in step 382 to notify the user of the low operating power level. To avoid excessive drain on the reserve backup battery, the processor 204 deactivates the clock movement unit 130 in step 385 or the standby switch 125 is opened in step 385 to stop the clock movement unit 130. The internal clock module 135 is maintained and powered by the reserve battery 175 in step 390 until a new battery is inserted (determined in step 395). If a new battery 150 is inserted, the process starting in step 350 is repeated.

If the low power detection module 145 does not detect any low operating power level, the processor 110 or 204 sends a first series of timed-pulses in step 397. The first series of timed-pulses preferably includes one pulse per second to indicate a normal lapse of time. The series of timed-pulses then controls the clock movement unit 130 in step 398. For example, if an analog display is desired, the pulses will then drive the stepping motor 155 (FIG. 1A) and move the hands of the analog clock 160 (FIG. 1A) in step 399. If a digital display is desired, the pulses will then trigger the digital component 165 (FIG. 1B) and in turn the digital display 170 (FIG. 1B) in step 399. Thereafter, the entire process starting in step 350 is repeated.

Figure 3:
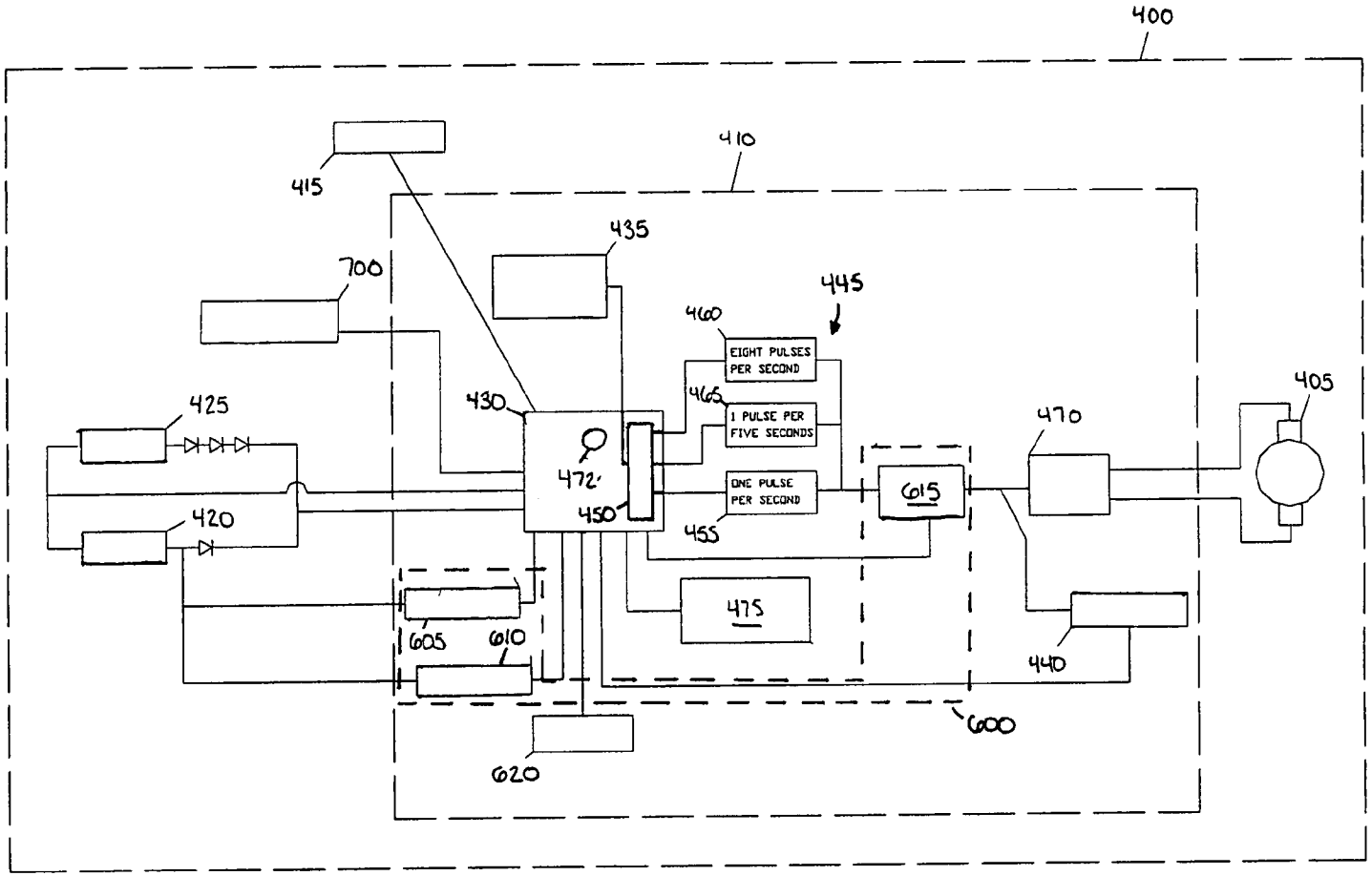
FIG. 3 is a schematic diagram of a third embodiment of a time keeping system in accordance with the present invention.

A time keeping system 400 of a third embodiment of the present invention and having multiple operational modes is illustrated in FIG. 3. The time keeping system 400 generally includes a clock movement unit 405, a processor or controller 410, a frequency generating unit 415, a primary power source 420, and a secondary power source 425. In one embodiment, the system 400 has a majority of its components residing in a conventional or standard compartment or gearbox, (e.g., a clockwork having the dimensions of 2 inches by 2 inches by ⅝ inches).

The clock movement unit 405 controls a display module (not shown). The movement unit 405 provides the mechanics or electronics necessary to advance or change a time being displayed by the display module (not shown) in response to timing signals or reference pulses generated by the controller 410. In one embodiment, the clock movement unit 405 is a clock motor, such as a bi-polar stepping motor, for advancing or changing an analog display (not shown). In another embodiment, the clock movement unit 405 is an electronic circuit for advancing or changing a digital display (not shown). Other clock movement units may be used as will be readily apparent to those of ordinary skill in the art.

The frequency generating unit 415 provides a reference frequency to the controller 410. In one embodiment, the frequency generating unit 415 is a quartz crystal. In other embodiments, the frequency generating unit 415 is an oscillator or a similar electronic device. The primary power source 420 generally provides power to the time keeping system 400, with the secondary power source 425 providing power to the time keeping system 400 during instances or time periods when the primary power source 420 is inoperable. In one embodiment, the primary power source 420 is a battery or multiple batteries, and the secondary power source 425 is a lithium battery. In another embodiment, the primary power source 420 is replaced by a lead (not shown) operable to be connected to a conventional wall outlet and by suitable electronics (not shown) to convert the conventional AC power signal to a DC signal. In a further embodiment, the secondary power source 425 provides power to only a selected number of modules (discussed below) within the controller 410 during an event when power from the primary power source 420 is interrupted.

The controller 410 controls the operation of the entire time keeping system 400. As mentioned briefly, the time keeping system 400 has multiple operational modes which are activated and deactivated by the controller 410. In one embodiment, the time keeping system 400 is capable of operating in a normal operation mode, a faster pulse operation mode, and a slower pulse operation mode, as will be more fully discussed below. The controller 410 includes a microprocessor or control unit or module (also referred to as a processing unit) 430, a first time registering device or time module 435, a second time registering device or time module 440, and a plurality of pulse indicating flags 445.

Generally, the control module 430 receives the reference frequency generated by the frequency generating unit 415 and provides pulses to the first time module 435 and to the second time module 440, as well as the clock movement unit 405. The pulses provided to the time modules 435 and 440 and to the clock movement unit 405 are generated by a pulse generating module or driver output 450 included in the control module 430. The pulse generating module 450, in one embodiment, provides a first plurality of reference pulses or timing signals and a second plurality of reference pulses or timing signals. Each plurality of reference pulses (also, referred to herein as simply "pulses" or a "plurality of pulses") has a frequency, and the pulse generating module 450 is capable of varying each frequency. The first time module 435 is operable to keep a first time in accordance with the first plurality of pulses and the second time module 440 is operable to keep a second time, which may differ from the first time, in accordance with the second plurality of pulses. In one embodiment, the clock movement unit 405 also receives the second plurality of pulses and controls the display module (not shown) to advance or change the time displayed according to the second plurality of pulses. In this way, the displayed time (i.e., the time displayed by the display module) corresponds to the second time kept by the second time module 440, since both the displayed time and the second time are advancing on the same pulse. The plurality of pulse indicating flags 445 are flags set by the control module 430 and indicate which operational mode is activated. In one embodiment, the plurality of pulse indication flags 445 includes a normal pulse flag 455, which indicates the normal operation mode, a faster pulse flag 460, which indicates the faster pulse operation mode, and a slower pulse flag 465, which indicates the slower pulse operation mode.

When the time keeping system 400 operates in the normal operation mode, the normal pulse flag 455 is set. The control module 430 receives the reference frequency generated by the frequency generating unit 415 and activates the pulse generating module 450. Upon activation from the control module 430, the pulse generating module 450 provides the first plurality of pulses to the first time module 435 and provides the second plurality of pulses to the second time module 440 and the clock movement unit 405. In the normal operation mode, the first plurality of pulses and the second plurality of pulse each has a frequency that corresponds to approximately one pulse per second. When the first time module 435 is receiving the first plurality of pulses, the first time module 435 increments its time by one second on reception of each pulse. When the second time module 440 and the clock movement unit 405 are receiving the second plurality of pulses, the times that correspond to both are incremented approximately at the same time. That is, the second time module 440 increments its time by one second on reception of each pulse, and the clock movement unit 405 increments the displayed time on the display module (not shown) by one second on reception of the same pulse received by the second time module 440. In one embodiment, when the clock movement unit 405 is a bi-polar stepping motor or another similar motor, the controller 410 includes a pulse inverter 470. The pulse inverter 470 converts the pulses in the second plurality of pulses to a more suitable signal for controlling the motor (clock movement unit) 405.

When the time keeping system 400 operates in the faster pulse operation mode or operates in the slower pulse operation mode, the control module 430 has detected a time difference between the first time kept by the first time module 435 and the second time kept by the second time module 440. In other words, the first time and the second time in the respective modules 435 and 440 do not agree. The control module 430 activates the faster pulse operation mode when the second time lags the first time or, in other words, the second time has to "speed-up" to the first time. The control module 430 activates the slower pulse operation mode when the second time exceeds the first time or, in other words, the second time has to "slow-down" to the first time.

The first time kept by the first time module 435 represents a real time or reference time. It is a time at which events may occur (as will be discussed more fully below) and/or a time to base or compare to the second time and displayed time. The second time kept by the second time module 440 corresponds to the time displayed by the display module (not shown), since both times increment at the same rate or frequency and increment at approximately the same instances. In one embodiment, the second time kept by the second time module 440 is an electronic version of the time displayed on an analog display (not shown).

The first time and second time can differ for various reasons; such as daylight savings time adjustments, power interruptions, variances in the pulse generating unit 450 or frequency generating unit 415, changes in an input timing signal, or other miscellaneous reasons, as will be more fully discussed below. In some embodiments, when the controller 410 recognizes hand positions of an analog display module (not shown), the first time and second time could differ due to human error when a user sets the time using the hands on the analog display. Since the first time and second time are driven or pulsed independently, the control module 430 continually compares both times to determine if a variance or time difference is present.

When the control module 430 detects a time difference between the first time and the second time, the control module 430 determines whether the second time has to "speed-up" or "slow-down" to the first time. When the second time has to "speed-up," the control module 430 sets the faster pulse flag 460 and commands the pulse generating module 450 to increase the frequency of the second plurality of pulses. The increase in frequency can be a single value or can be dependent upon the time difference and determined by an algorithm within the control module 430. Upon command from the control module 430, the pulse generating module 450 continues to provide the first plurality of pulses to the first time module 435 at the normal operation mode (i.e., one pulse per second), while providing the second plurality of pulses to the second time module 440 and the clock movement unit 405 at an increased frequency or rate. During the faster pulse operation mode, both the time modules 435 and 440 and the clock movement unit 405 increment their respective times by one second on reception of each pulse. However, the second time module 440 and the clock movement unit 405 are incrementing their respective times at a much faster rate than the first clock module 435, because of the increased frequency of the second plurality of pulses. After the reception of each pulse from the second plurality of pulses, the control module 430 compares the second time to the first time. If the times do not agree, then the system 400 continues to operate in the faster pulse operation mode until the time difference is substantially reduced. When the times agree or the time difference is substantially reduced, the control module 430 activates the normal operation mode. The faster pulse flag 460 is reset by the control module 430 and the normal pulse flag 455 is set.

When the second time has to "slow-down," the control module 430 sets the slower pulse flag 465 and commands the pulse generating module 450 to decrease the frequency of the second plurality of pulses. The decrease in frequency can be a single value or can be dependent upon the time difference and determined by an algorithm within the control module 430. Upon command from the control module 430, the pulse generating module 450 still provides the first plurality of pulses to the first time module 435 at the normal operation mode, that is one pulse per second, while providing the second plurality of pulses to the second time module 440 and the clock movement unit 405 at a decreased frequency or rate. During the slower pulse operation mode, both the time modules 435 and 440 and the clock movement unit 405 increment their respective times by one second on reception of each pulse. However, the second time module 440 and the clock movement unit 405 are incrementing their respective times at a much slower rate than the first clock module 435, because of the decreased frequency of the second plurality of pulses. After the reception of each pulse from the second plurality of pulses, the control module 430 compares the second time to the first time. If the times do not agree, the system 400 continues to operate in the slower pulse operation mode until the time difference is substantially reduced. When the times agree or the time difference is substantially reduced, the control module 430 activates the normal operation mode. The slower pulse flag 465 is reset by the control module 430 and the normal pulse flag 455 is set.

In another embodiment, the time keeping system 400 includes an internal calendar module 472 within the control module 430 for storing date information, such as day, month and year, and includes a memory module or memory bank 475 within the controller 410 for storing event and time information, such as daylight savings information and/or programmed functions. In this embodiment, the system 400 is capable of operating in an event operation mode. During the event operation mode, the system 400 operates similarly to the normal operation mode, but with the control module 430 executing an event. The control module 430 continually checks or compares the information stored in the memory bank 475 with the current time kept by the first time module 430 and the current date kept by the internal calendar module 472. Generally, the information stored in the memory bank 475 includes an action and a time when the action needs to occur. In one embodiment, the memory bank 475 stores daylight savings information, such as an action (i.e., advancing or retracting one hour from the first time kept in the first time module 435) and a time (i.e., date and time of day) when the action needs to occur. In another embodiment, the memory bank 475 stores alarm information, such as an action (i.e., activating a buzzer, bell, radio, light, animal feeder, or another similar device, all not shown) and a time when the action needs to occur. When the time stored in the memory bank 475 agrees or corresponds to the current time and date kept by the first time module 435 and internal calendar module 472, respectively, as compared by the control module 430, then the control module 430 reads the action that corresponds to the time stored in the memory bank 475 and executes the action.

Figure 4:
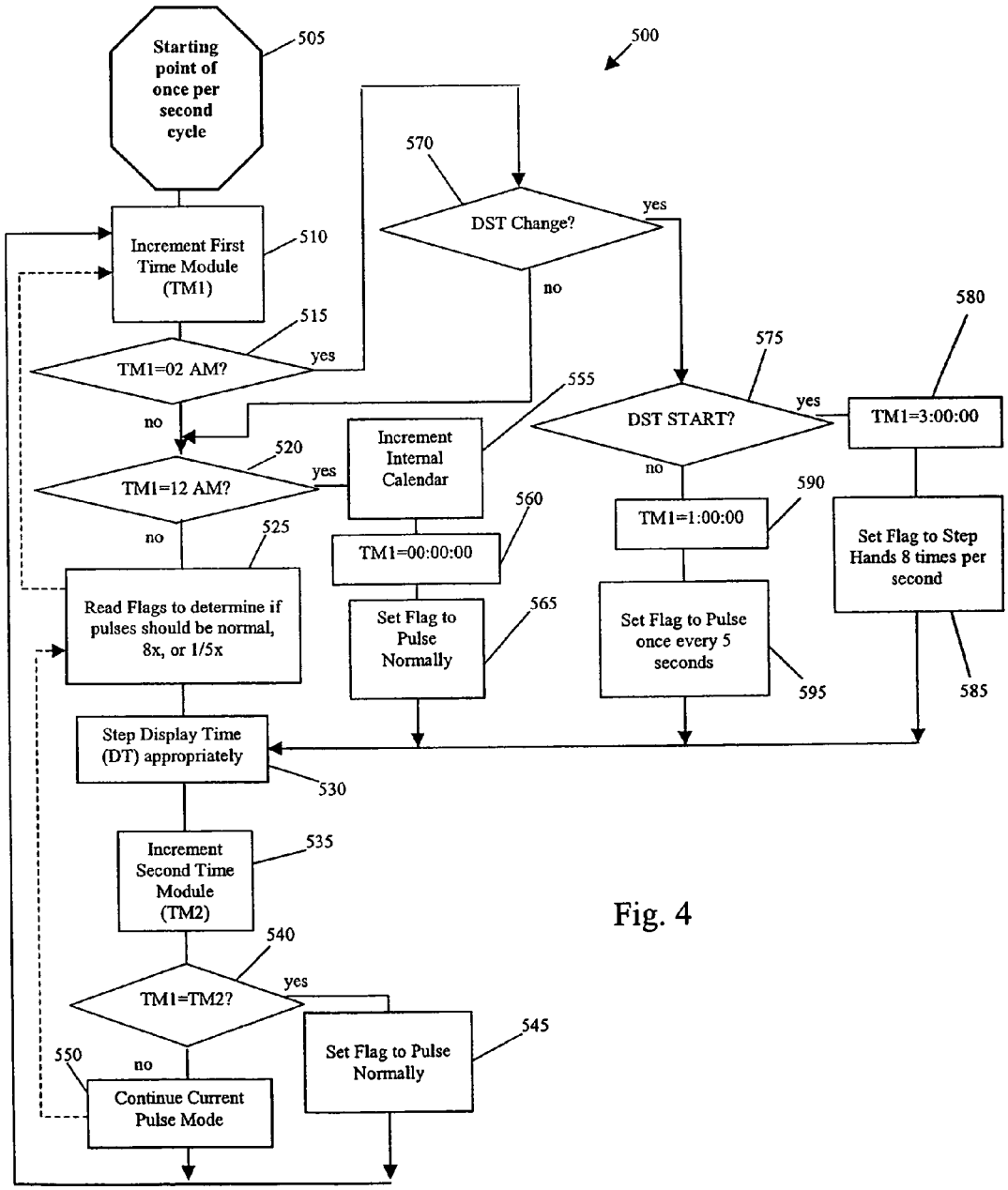
FIG. 4 is a flow diagram illustrating the functionality and operation of another embodiment of a time keeping system in accordance with the present invention.

Referring now to FIG. 4, a flow diagram 500 illustrates the event operation mode of the time keeping system 400 with respect to daylight savings information stored in the memory bank 475. The flow diagram 500 starts at step 505 with the time keeping system 400 establishing the first plurality of pulses having a frequency of approximately one pulse per second. At step 510, the first time module 435 receives a pulse from the first plurality of pulses and increments its time by one second. At step 515, the control module 430 determines if the first time held by the first time module 435 corresponds to a first time information stored in the memory bank 475, e.g., 2:00 a.m. If the time held by the first time module 435 does not correspond to the first time information (i.e., 2:00 a.m.), then, at step 520, the control module 430 determines if the time held by the first time module 435 corresponds to a second time information stored in the memory bank 475, e.g., 12:00 a.m.

When the time held by the first time module 435 at step 520 does not correspond to the second time information (i.e., 12:00 a.m.), the control module 430 reads the pulse indicating flags 445 to determine the frequency of the second plurality of pulses and, ultimately, the operational mode of the time keeping system 400. The pulse indicating flags are determined by the control module 430 during step 525. In one embodiment of the system 400, the second plurality of pulses has three different frequencies, a first frequency, a second frequency and a third frequency. The first frequency is used during the normal operation mode and is approximately one pulse per second. The second frequency is used when the second time kept by the second time module 440 is behind the first time kept by the first time module 435, causing the second time module 440 to increment its time at a faster rate until the first time agrees with the second time. During the faster pulse operation mode, the frequency of the second plurality of pulses is approximately eight pulses per one second. The third frequency is used when the second time kept by the second time module 440 is ahead of the first time kept by the first time module 435, causing the second time module 440 to increment its time at a slower rate until the first time agrees with the second time. During the slower pulse operation mode, the frequency of the second plurality of pulses is approximately one pulse per five seconds.

Once the control module 430 determines the frequency at which the second plurality of pulses are to occur in step 525, the clock movement unit 405 increments the displayed time accordingly at step 530. Approximately at the same occurrence, the second time module 440 increments the second time accordingly at step 535. The events which take place at steps 530 and 535 occur almost simultaneously, since both are triggered by the reception of one pulse from the second plurality of pulses.

Once the displayed time and the second time have been incremented accordingly at steps 530 and 535, respectively, the control module 430 compares the first time kept by the first time module 435 with the second time kept by the second time module 440 at step 540. If the first time and the second time agree, then the control module 430 sets the normal pulse flag 455 and the time keeping system 400 is set to operate in the normal operation mode. This occurs at step 545. If the first time and the second time do not agree at step 540, then the control module 430 does not set or reset any pulse indicating flags, and the time keeping system 400 continues to operate in the current operational mode.

If the time keeping system 400 is operating in the faster pulse operation mode as indicated during step 525 by the faster pulse flag 460, then the system 400 implements a subroutine after step 550. Since it was indicated in step 525 that the system 400 is operating in the faster pulse operation mode (i.e., the second plurality of pulses are being provided at a frequency that is eight times faster than the frequency of the first plurality of pulses), the system 400 repeats steps 525-540 seven more times before proceeding back to step 510. Steps 525-540 are repeated seven more times during the faster pulse operation mode, because the second time module 440 receives seven more pulses before the first time module 435 receives its second pulse from the first plurality of pulses, which would occur at step 510. Therefore, steps 525-540 need to be implemented more frequently during the faster pulse operation mode, because the second plurality of pulses are being provided at a faster frequency than the first plurality of pulses.

Similarly, if the time keeping system 400 is operating in the slower pulse operation mode as indicated during step 525 by the slower pulse flag 465, then the system 400 implements a subroutine after step 525. Since it was indicated in step 525 that the system 400 is operating in the slower pulse operation mode (i.e., the second plurality of pulses are being provided at a frequency that is five times slower than the frequency of the first plurality of pulses), the system 400 repeats steps 510-525 four more times before continuing on to step 530. Steps 510-525 are repeated four more times during the slower pulse operation mode, because the first time module 435 receives four more pulses before the second time module 440 and the clock movement unit 405 receive their second pulse from the second plurality of pulses, which would occur at steps 530 and 535. Therefore, steps 510-525 need to be implemented more frequently during the slower pulse operation mode, since the second plurality of pulses are being provided at a slower frequency than the first plurality of pulses.

Referring back to step 520, when the first time held by the first time module 435 corresponds to the second time information stored in the memory bank 475 (i.e., 12:00 a.m.), the control module 430 reads the action associated with the stored time information in the memory bank 475. For example, the action corresponding to the second time information is to increment the internal calendar module 475 and reset the first time held by the first time module 435 to its beginning reference point. The control module 430 then performs the action, such as incrementing the internal calendar module 472 at step 555, and the first time is reset to the beginning reference point at step 560. In one embodiment, the reference point is 00:00:00. The controller sets the normal pulse flag 455 and the time keeping system 400 is set to operate in the normal operation mode at step 565. Operation of the system 400 continues through steps 530-540, as discussed above.

Referring back to step 515, when the first time held by the first time module 435 corresponds to the first time information stored in the memory bank 475 (i.e., 2:00 a.m.), the control module 430 then reads the action corresponding to the first time information stored in the memory bank 475. For example, the action required by the first time information is to determine if a daylight savings time change is supposed to take place by comparing the date information stored in the memory bank 475 with the current date held by the internal calendar module 472. Therefore, the control module 430 reads the daylight savings time information stored in the memory bank 445 and compares it to the current date held by the internal calendar module 472 at step 570. If no daylight savings time change is supposed to take place at step 570 (i.e., the date information stored in the memory bank 475 does not correspond with the current date held by the internal calendar module 472), then the system 400 proceeds to step 520 and continues as described above. If a daylight savings time change is supposed to take place at step 570 (i.e., the date information stored in the memory bank 475 corresponds to the current date held by the internal calendar module 472), then the control module 430 determines what type of daylight savings time change is supposed to take place at step 575.

If the action stored in the memory bank 475 requires the daylight savings time change to advance one hour, as shown at step 575, then the control module 430 performs the action of advancing the first time held by the first time module 435 one hour or, in other words, sets the first time module 435 to 3:00:00. This occurs at step 580. At step 585, the control module 430 sets the faster pulse flag 460 and the time keeping system 400 is set to operate in the faster pulse operation mode. The system 400 proceeds to step 530 and continues as described above.

If the action stored in the memory bank 475 requires the daylight savings time change to retract one hour at step 575, then the control module 430 performs the action of retracting one hour from the first time held by the first time module 435 or, in other words, sets the first time module 435 to 1:00:00. This occurs at step 590. At step 595, the control module 430 sets the slower pulse flag 465 and the time keeping system 400 is set to operate in the slower pulse operation mode. The system 400 proceeds to step 530 and continues as described above.

Referring again to FIG. 3, in yet another embodiment of the time keeping system 400, the controller 410 can further include an interruption module 600. Generally, the interruption module 600 detects a power interruption or a low-voltage signal from the primary power source 420 and provides signals to the control module 430 to activate a low-power operation mode.

The interruption module 600 includes a low-voltage detection module 605, a power source detection module 610 and a pulse limiting module 615. The low-voltage detection module is operable to detect if the primary power source 420 is not supplying enough voltage to the time keeping system 400. The power source detection module 610 is operable to detect an interruption in power from the primary power source 420, such as the removal of the battery (if the primary power source 420 is a battery) or if the primary power source was disconnected from the system 400. When the low-voltage detection module 605 detects a low-voltage signal from the primary power source or when the power source detection module 610 detects an interruption in the primary power source 420, the control module 430 sets a power out flag 620. The power out flag 620 indicates that an interruption in power or a low-voltage signal from the primary power source 420 has been detected. The pulse limiting module 615 interrupts or limits the second plurality of pulses, prohibiting the second time module 440 and the clock movement unit 405 from incrementing, in the event low power is detected.

Figure 5:
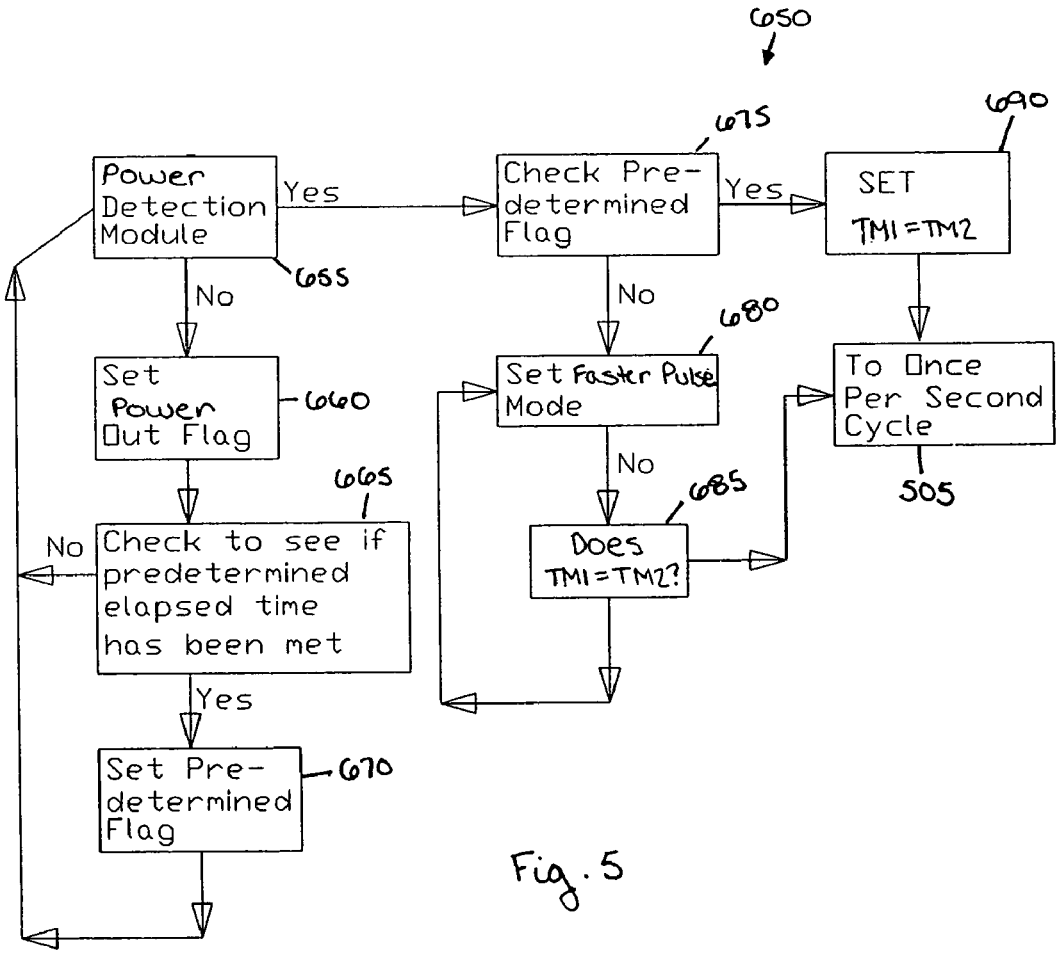
FIG. 5 is a flow diagram illustrating the functionality and operation of yet another embodiment of a time keeping system in accordance with the present invention.

Referring to FIG. 5, a flow diagram 650 illustrates the operation of the interruption module and the low-power operation mode of the time keeping system 400. The flow diagram 650 starts at step 655 when the low-voltage module 605 and the power source detection module 610 determine enough power is being supplied to the system 400 from the primary power source 420. If low voltage or power interruption is detected by the modules 605 or 610 in step 655, the control module 430 sets the power out flag at step 660. At step 660, the control module 430 activates the low power operation mode and power is supplied to the system 400 by the secondary power source 425. During the low power operation mode, power and pulses are still supplied to the first time module 435, allowing the module 435 to continue keeping time. The control module 430, at step 660, also commands the pulse limiting module 615 to interrupt or limit the second plurality of pulses supplied to the second time module 440 and the clock movement unit 405. This causes the second time module 440 and the display module (not shown) to "freeze" the time held in each respective module. Only a minimal amount of power is required by the system 400 to maintain the "frozen" time in the second time module 440 and the display module. Furthermore, at step 660, the control module 430 starts a power out timer (not shown) counting toward an elapsed time.

At step 665, the control module 430 determines if the elapsed time as counted by the power out timer has been met. If the elapsed time has not been met in step 665, the system 400 continues back to step 655. If the elapsed time has been met in step 665, the control module 670 sets a predetermined flag (not shown) and interrupts the minimal power being supplied to the second clock module 440 and the display module. This erases the time that was stored or "frozen" in the second time module 440. In other words, the predetermined flag indicates that there is no time or information presently stored or kept by the second time module 440. Power is no longer supplied to the second time module 440 in order to conserve power from the secondary power source 425. Once the predetermined flag is set in set 670, the system continues back to step 655.

If both the low-voltage module 605 and the power source detection module 610 detect enough power being supplied to the system 400, the control module 430 checks the status of the predetermined flag (not shown) at step 675. If the predetermined flag is not set, the control module 430 activates the faster pulse operation mode and the second plurality of pulses are restored to the second time module 440 and the clock movement unit 405 at a faster frequency. On the reception of each pulse from the second plurality of pulses, the control module 430 compares the first time kept by the first time module 435 to the second time kept by the second time module 440 at step 685. When the first time does not agree or correspond to the second time at step 685, the system 400 continues to step 680. When the first time agrees with the second time at step 685, the control module 430 activates the normal operation mode and the system 400 would continue to operate in the normal operation mode. In one embodiment, the system 400 activates the normal operation mode and would continue to step 505 of FIG. 4.

Referring back to step 675, when the control module 430 recognizes that the predetermined flag was set at step 675, the control module 430 stores the first time kept by the first time module 435 as the second time in the second time module 440 at step 690 and resets the predetermined flag, in one embodiment. The control module 430, then, activates the normal operation mode and the system 400 would continue to operate in the normal operation mode. In another embodiment, the control module 430 indicates to a user by an output device (not shown), e.g., light, sound, a visual indicator, etc., that the time displayed by the display module (not shown) may not correspond to the first time or reference time kept by the first time module 435. This indicates to the user that a setting method should be performed, as will be more fully discussed below. In a further embodiment, the system 400 activates the normal operation mode and would continue to step 505 of FIG. 4.

Referring again to FIG. 3, in yet a further embodiment of the time keeping system 400, the system 400 can further include an input port 700. The input port 700 allows an external device (external meaning outside the scope of the controller 410) to have the capability to provide the controller 410 with information. The information could be event and/or time information to store in the memory bank 475, timing and/or reference signals to store in the first time module 435 or second time module, date information to store in the internal calendar module 472, programming instructions to store in the memory bank 475 or execute by the control module 430, or various other forms of information. For example, the input port 700 can take the form of a digital display panel that allows a user to program the first time module 435 and the internal calendar module 472 with time, day and date information. The input port 700 can also take the form of a receiver that receives timing or reference signals by radio frequency. The receiver (the input port) 700 could receive a signal having a time signal component and/or a programmed instruction from a primary master device, as described in U.S. patent application Ser. No. 09/960,638, filed on Sep. 21, 2000, now U.S. Pat. No. 6,873,573, the entire content of which is incorporated herein by reference.

If the input port 700 receives timing information from an external source, the controller 410 stores the input time information into the first time module 435 and proceeds to compare the first time (i.e., the input time information from the external device) to the second time kept by the second time module 440. Depending on whether the times agree or not, the controller 410 performs the necessary steps to reduce the time difference between the first time and the second time, as discussed above.

The time keeping system 400 as illustrated in FIG. 3 generally includes the clock movement unit or module 405 and the controller 410, as discussed above. The controller 410 generally includes the control module 430, the first time module or clock module 435 and the second time module or clock module 440, as also discussed above. As is apparent to one skilled in the art, the controller 410 has the capability to include more or fewer modules or functionalities than described above or shown and described in the figures. For example, the first and second time module 435 and 440 can keep solar and/or lunar time. As is apparent to one skilled in the art, the system 400 could be capable of indicating tidal activity based on the lunar and solar times kept by the time modules 435 and 440. Accordingly, the controller 410 can perform various other functions and include different modules that will allow the system 400 to commence operation upon the conclusion of various setting methods performed by a user, as will be more fully discussed below.

There are numerous setting methods that can be used to commence operation of the time keeping system 100, 200, and/or 400 for the first operation (i.e., the first time the time keeping system 100, 200, and/or 400 is activated after manufacturing) or to commence operation after the low-power operation mode. Typically, in either case, the second time and display time do not correspond with the first time or reference time and need to be set so that both times (the display time and the second time) correspond to the first time. Setting methods need to be performed or conducted, for example, when the predetermined flag (as discussed in relation to FIG. 5) is set and indicates to a user that the time displayed by the display module (not shown) may not correspond to the first time or reference time kept by the first time module 435.

There are some setting methods that can be used with the time keeping system 100, 200, and/or 400 having an analog clock and display as the display module (not shown) and as the clock movement unit 405. The analog display and clock movement unit (referred to herein as "analog display 405") 405 generally includes a second hand, a minute hand, an hour hand, and hand gears or wheels to move a respective hand.

Generally, for some setting methods, the first time module 435 is programmed with a current time and date information during manufacturing. This current time and date information corresponds to a time zone, typically, the time zone where the system 100, 200, and/or 400 is manufactured. For explanatory purposes in regard to the description of the setting methods below, the time and date information provided to the first time module 435 during manufacturing corresponds to the current time and date in the Central time zone.

After manufacturing, the secondary power source 425 supplies power to the controller 410 during instances when primary power is absent (i.e., when the system 100, 200, and/or 400 is shipped after manufacturing or when the system 100, 200, and/or 400 is operating in the low-power operation mode), allowing the first time module 435 to continue keeping the first time. In these instances, the predetermined flag would be set, indicating that there is no time stored in the second time module 440. The analog display 405 would not display and keep a display time that corresponds to the first time until a setting method: 1) activates the system 100, 200, and/or 400, once primary power is restored; or 2) commences operation of the system 100, 200, and/or 400 for the first time after manufacturing.

A first setting method is used for the time keeping system 100, 200, and/or 400 that allows a user to set the display time to correspond to his/her time zone, which may differ from the time zone designated during manufacturing. For explanatory purposes, the first time kept by the first time module 435 corresponds to the time according to the Central time zone. The first setting method includes a user positioning hands of the analog display 405 to an appropriate hour that reflects or represents a time zone or location. For example, if the current time according to the Central time zone is 12:00, then the first time kept by the first time module 435 reads 12:00:00. To designate the Pacific time zone, the user would position the hands of the analog display 405 to approximately 10:00, two hours behind the current time according to the Central time zone. Approximately 11:00 would designate the Mountain time zone and approximately 1:00 would designate the Eastern time zone. As stated earlier, approximately 12:00 would designate the Central time zone. The setting method could also include designating approximately 9:00 for time in Alaska and designating approximately 8:00 for time in Hawaii.

Still referring to the first setting method, when the hands of the analog display 405 are set to an appropriate time (i.e., the approximate time in each time zone), the user connects the primary power source 420 to the system 100, 200, and/or 400. In one embodiment, the user would insert a primary battery (primary power source) 420 into a battery compartment (not shown). When primary power is restored, the control module 430 sets the hands of the analog display 405 to a time which corresponds to the first time held by the first time module 435. In this method, the controller 410 "assumes" that the hour at which the analog display 405 is set corresponds to approximately the current hour or time kept by the first time module 435. When the controller 410 adjusts the hands of the display 405, the display time appropriately reflects the designated time zone as indicated by the user. When the user performs the first setting method and the analog display 405 displays a time corresponding to the first time kept by the first time module 435, the control module 430 sets the second time in the second time module 440 to agree with the first time, and the system 100, 200, and/or 400 commences operation.

According to the first setting method, the first time and the second time will agree (i.e., both will read 12:00:00), but the display time, if set for a different time zone by the user, will reflect a time that differs from the first and second times. The display time still increments at the same frequency or rate as the second time, but is ahead or behind by one hour or more. Simply stated, the user "tricks" the controller 410 to display a time that corresponds to a different time zone. The display time will be offset from the first and second time by an hour, two hours, etc., depending on the difference in time between the time zone in which the user sets the analog display 405 and the Central time, as an example.

A second setting method is used for the time keeping system 100, 200, and/or 400 that includes a designate time zone switch or module (not shown) to adjust the first time, second time and/or both times. A user sets the hands of the analog display to approximately 12:00. When the hands are set, the user activates the time zone module (not shown) to designate a time zone or location (e.g., designates Pacific time zone, Mountain time zone, Central time zone, Eastern time zone, Alaska, or Hawaii, etc.). The user connects the primary power source 420 to the system 100, 200, and/or 400, which, in one embodiment, includes the user inserting a primary battery (primary power source) 420 into a battery compartment (not shown). Depending on the time zone designated by the time zone module, the controller 410 adjusts the first time kept by the first time module 435 to reflect the time zone designation (e.g., advance the first time by one hour if the Eastern time zone is selected, retract two hours from the first time if the Pacific time zone is selected, etc.) and the controller 410 sets the second time kept by the second time module 440 to 12:00:00. After the first time is adjusted and the second time is set, the controller 410 automatic increments the hands of the analog display 405 and the second time until the display time and the second time correspond to the first time kept by the first time module 435, as discussed above.

A third setting method is used for the time keeping system 100, 200, and/or 400 that includes the time zone switch or module (not shown) and a clock hands recognition module (not shown). In one embodiment, the clock hands recognition module includes clock optics or an optical circuit that optically detects a position of the hands of an analog display 405 and records the time associated with the position in the second time module 440. A user activates the time zone module to designate a time zone or location (e.g., designates Pacific time zone, Mountain time zone, Central time zone, Eastern time zone, Alaska, or Hawaii, etc.). The controller 410 adjusts the first time kept by the first time module 435 to reflect the time zone designation. When a time zone is designated, the clock hands recognition module detects the hand position of the analog display 405 and stores the time associated with the hand position in the second time module 440. The user connects the primary power source 420 to the system 100, 200, and/or 400, which, in one embodiment, includes the user inserting a primary battery (primary power source) 420 into a battery compartment (not shown). When primary power is restored, the controller 410 increments the display time (i.e., the hands of the analog display 405) and the second time to correspond to the first time kept by the first time module 435, as discussed above.

The clock hands recognition module (not shown), in another embodiment, is a manual push-button that a user operates to record hand position of an analog display 405. A user sets the hands of the analog display 405 within one hour of the current time or the first time as kept by the first time module 435. The user connects the primary power source 420 to the system 100, 200, and/or 400, which, in one embodiment, includes the user inserting a primary battery (primary power source) 420 into a battery compartment (not shown). When the primary power source 420 is connected to the system 100, 200, and/or 400, the system will commence operation, that is, the analog display 405 increments the display time.

In this embodiment, when the second hand of the analog display 405 reaches the "12" position on the display, the user operates or presses the push-button to identify or recognize the second hand position. The controller 410 begins incrementing the second time kept by the second time module 440 to correspond with the second hand of the analog display 405. When the second hand crosses the position of the minute hand, the user operates or presses the push-button again to identify or recognize the position of the minute hand. The controller 410 uses the second time kept by the second time module 440 (which corresponds to an elapsed time between operations of the push-button) to derive the position of the minute hand of the analog display 405. The controller 410 "assumes" the position of the hour hand of the analog display 405 reflects the current hour and increments the display time (i.e., the second hand and minute hand of the analog display 405) to a time that corresponds to the first time kept by the first time module 435. In other embodiments, the system 100, 200, and/or 400 can include the time zone module (not shown) and can use the module to adjust the first and/or second time, as discussed above.

Another variation of the above setting method uses the manual push-button (the clock hands recognition module) to record the position of the second, minute, and hour hand of the analog display 405. As stated earlier in the embodiment above, a user set the hands of the analog display 405 approximately to the current time and connects the primary power source 420 to the system 100, 200, and/or 400. This causes the analog display 405 to increment the display time. When the second hand crosses the "12" position on the analog display 405, the user operates the push-button to identify that the second hand is at the 12 position. The controller 430 begins to increment the second time in the second time module 440 to correspond to the incrementing second hand of the analog display 405. When the second hand crosses the minute hand, the user operates the push-button to identify that the second hand is at the minute hand position. The controller 410 uses the second time kept by the second time module 440 to derive the position of the minute hand. When the second hand crosses the hour hand, the user again operates the push-button to identify that the second hand is at the hour hand position. The controller 410 uses the second time kept by the second time module 440 to derive the position of the hour hand. When the controller 410 has derived and identified the positions of each hand, the controller 410 sets the second time to correspond with the display time (i.e., the time indicated by the position of the hands) and increments the display time and the second time accordingly, until the second time agrees with the first time, as discussed above.

This setting method can also be performed in the time keeping system 100, 200, and/or 400 that includes the time zone module (not shown). The controller 410 can adjust the first time, second time or both to correspond to the designated time zone as indicated by the time zone switch, as discussed above. Furthermore, this setting method can also be performed by the system 100, 200, and/or 400 having a clock hands recognition module that uses clock optics or an optical circuit to record or identify the position of the hands rather than having a user operating a manual push-button.

There are also numerous additional setting methods that can be also used to commence operation of the time keeping system 100, 200, and/or 400. These additional setting methods allow a user or external device to determine a current time and, ultimately, set or change the first time kept by the first time module 435. These setting methods can be used with the system 100, 200, and/or 400 that either has a first time programmed into the first time module 435 during manufacturing (and operates and increments that first time once it is established at manufacturing), or does not have a first time programmed into the first time module 435.

One additional setting method is used with the time keeping system 100, 200, and/or 400 having an input port 700, as described earlier. A user sets the hands of the analog display 405 to 12:00 and connects the primary power source 420 to the system 100, 200, and/or 400. Using the input port 700, the user or an external device inputs time and date information to the controller 410. The controller 410 sets the second time in the second time module 440 to 12:00:00 (i.e., the displayed time or the position of the hands of the analog display 405) and sets the first time in the first time module 435 to the time and/or date information that was provided by the external device (not shown). The controller 410 then increments the second time and the display time accordingly, until the second time and first time approximately agree. The input port 700 can also display the inputted information on a digital display or another display device or mechanism.

Another additional setting method is used in the time keeping system 100, 200, and/or 400 having position sensors (not shown) or mechanical trigger devices (not shown) on the hand gears. The sensors and/or trigger devices are capable of indicating the position of the hands on the analog display 405 by sensing the position of the respective gears. When the user set a time on the analog display 405 and connects the primary power source 420, the sensors and/or trigger devices identifies the position of the hands or, in other embodiments, identifies just the position of the hour hand. The controller 410 adjusts the first time kept by the first time module 435 according to the position of the hands. In the embodiment where just the hour position is identified, this setting method allows the user to adjust the first time to correspond with a time zone that the user indicates when he/she positions the hour hand.

Thus, the invention provides, among other things, a time keeping system including a daylight savings time keeping function. Various features and advantages of the invention are set forth in the following claims.

The invention claimed is:

1. A time keeping system comprising:

a first time module operable to keep a first time;

a second time module operable to keep a second time; and a control module operatively coupled to the first time module and the second time module, the control module operable to make a daylight savings adjustment to the first time in response to information stored in the control module and to adjust the second time to reduce a time difference between the first time and the second time.

2. The time keeping system of claim 1, further comprising a pulse generating module providing a first plurality of reference pulses to the first time module and providing a second plurality of reference pulses to the second time module, the second plurality of reference pulses having a first frequency, the first time advancing a predetermined amount in response to each reference pulse in the first plurality of reference pulses and the second time advancing a predetermined amount in response to each reference pulse in the second plurality of reference pulses.

3. The time keeping system of claim 2, wherein the second time is adjusted by increasing the first frequency to a second frequency.

4. The time keeping system of claim 3, wherein the second frequency is approximately eight times the first frequency.

5. The time keeping system of claim 2, wherein the second time is adjusted by decreasing the first frequency to a second frequency.

6. The time keeping system of claim 5, wherein the second frequency is approximately one-fifth of the first frequency.

7. The time keeping system of claim 1, further comprising a display for displaying a third time corresponding to the second time kept by the second time module.

8. The time keeping system of claim 7, wherein the display comprises an analog display.

9. The time keeping system of claim 1, wherein the control module adjusts the first time substantially instantaneously and adjusts the second time over a period of time.

10. The time keeping system of claim 1, wherein the control module adjusts the first time ahead substantially one hour and thereafter adjusts the second time until the second time substantially equals the first time.

11. The time keeping system of claim 1, wherein the control module adjusts the first time back substantially one hour and thereafter adjusts the second time until the second time substantially equals the first time.

12. The time keeping system of claim 1, further comprising:

a primary power source operable to supply power to the first time module, the second time module, and the control module; and a secondary power source operable to supply power to the first time module and the control module when power supplied by the primary power source changes.

13. The time keeping system of claim 12, further comprising an interruption module operable to prevent the second time from advancing.

14. The time keeping system of claim 13, wherein the interruption module is operable to prevent the second time from advancing upon the control module detecting a change in the power supplied by the primary power source.

15. The time keeping system of claim 13, wherein the first time module, the second time module, the control module, the interruption module, and at least one of the primary power source and the secondary power source are all contained in a standard clockwork that is approximately two inches long, approximately two inches wide, and approximately five-eighths of an inch high.

* * * * *